US005655921A

United States Patent [19]

Makal et al.

[11] Patent Number: 5,655,921

[45] Date of Patent: Aug. 12, 1997

[54] LOADBREAK SEPARABLE CONNECTOR

[75] Inventors: John Mitchell Makal, Menomonee Falls; Henry Allan Hecker, Pewaukee, both of Wis.

[73] Assignee: Cooper Industries, Inc., Houston, Tex.

[21] Appl. No.: 478,562

[22] Filed: Jun. 7, 1995

[51] Int. Cl.[6] ..... H01R 4/60

[52] U.S. Cl. ..... 439/206; 439/921

[58] Field of Search ..... 439/183, 184, 439/185, 186, 187, 921, 181, 206, 182; 29/876

[56] References Cited

U.S. PATENT DOCUMENTS

| | | | |
|---|---|---|---|
| 3,678,432 | 7/1972 | Boliver | 439/206 |
| 4,170,394 | 10/1979 | Conway | 339/111 |
| 5,221,220 | 6/1993 | Roscizewski | 439/843 |

*Primary Examiner*—Neil Abrams
*Assistant Examiner*—Yong Kim
*Attorney, Agent, or Firm*—Conley, Rose & Tayon, P.C.

[57] ABSTRACT

Apparatus and methods for reducing the risk of flashover during loadbreak operations of insulated separable connectors. In one aspect, the flashover distance for an electrical connector assembly is increased by supplementing exposed conductive portions of the male connector with insulated portions such that energized points on the energized connector are placed a greater distance away from the nearest ground plane on the complimentary connector. The additional insulation compensates for reductions in dielectric strength of the air occurring during separation of the male connector from the female connector. Also, the semi-conductive ground shield of the bushing is supplemented by an insulating sleeve. The insulative sleeve effectively removes a common ground plane to which an arc might tend during a flashover. In another aspect, a substantial airtight seal is prevented between elastomeric seals of the female connector and the probe of the male connector. The connection being thus vented, the available volume of air surrounding the energized components of the connector assembly is increased. In described embodiments, the probe portion of the elbow is configured to prevent substantial sealing between the connector components. An annular reduced diameter recess is located between the probe's metal rod and its arc follower and is elongated to prevent substantially airtight sealing between the elbow and bushing during the initial stages of the loadbreak operation itself. In alternative embodiments, the probe may be hollow and vented or include a groove disposed along its length.

17 Claims, 4 Drawing Sheets

LOADBREAK SEPARABLE CONNECTOR

BACKGROUND OF THE INVENTION

1. Field of the Invention

The present invention relates to electrical connector assemblies such as those used to connect portions of electrical utilities below-ground and more particularly to loadbreak separable connectors.

2. Description of the Related Art

High-voltage separable connectors interconnect sources of energy such as transformers to distribution networks or the like. Frequently, it is necessary to connect and disconnect the electrical connectors. These connectors typically feature an elbow component, which contains a male connector, and a bushing component, which contains a female connector. When the components are connected, elastomeric O-tings seal the connection.

Disconnecting energized connectors is an operation known as a loadbreak. A problem known as "flashover" has been known to occur while switching or separating loadbreak separable connectors. The male connector probe is typically maintained within the elbow, and the female connector contact is contained within the bushing. During a loadbreak operation, the elbow is pulled from the bushing using a hotstick to separate the components. This, in effect, creates an open circuit. During separation, a phenomenon known as a flashover may occur where an arc from the energized connector extends rapidly to a nearby ground. Existing connector designs contain a number of arc extinguishing components so that the devices can have loadbreak operations performed under energized conditions with no flashover to ground occurring. The object of caution is to control the arc and gases generated during loadmake and loadbreak operations. Even with these precautions, however, flashovers have occurred on rare occasions. In a flashover, an arc extends from an energized portion of one of the connectors and seeks a nearby ground. Flashovers commonly occur during the initial approximate one-inch of separation of the connectors from each other. The separation of the elbow from the bushing causes a partial vacuum to surround the energized components of the connector assembly. Because a partial vacuum presents a lower dielectric strength than that of air at atmospheric pressure, a flashover is more likely to occur at the moment as the elastomeric seal between the components is broken and before atmospheric pressure is reestablished around the energized portions of the components. Also, after being connected over a long period of time, the elbow may adhere to the bushing interface so that the connectors cannot be easily disengaged. This is known as a stuck condition, and greater force is required to separate the elbow resulting in a more rapid change in pressure and dielectric strength in the air surrounding the energized components.

During a flashover, an electrical arc between the energized components and ground may result which could cause damage to the equipment and possibly create a power outage. The problem of flashovers involves principally 25 KV and 35 KV loadbreak connectors but may also include 15 KV connectors.

SUMMARY OF THE INVENTION

The apparatus and methods of the present invention reduce the risk of flashover during loadbreak operations. In one aspect of the invention, the flashover distance for an electrical connector assembly is increased by supplementing exposed conductive portions of the male connector with insulated portions such that energized points on the energized connector are placed a greater distance away from the nearest grounded point. The additional insulation compensates for reductions in dielectric strength occurring during separation of the male connector from the female connector. Also, the semi-conductive ground shield of the bushing is supplemented by an insulating sleeve. The insulative sleeve effectively covers the nearest ground plane to which an arc might tend during a flashover.

In another aspect of the invention, a substantial airtight seal is prevented between elastomeric seals of the female connector and the probe of the male connector. The connection being thus vented, the available volume of air surrounding the energized components of the connector assembly is increased. In described embodiments, the probe portion of the elbow is configured to prevent substantial vacuum-type sealing between the connector components. An annular reduced diameter recess is located between the probe's metal rod and its arc follower and is elongated to prevent substantially airtight sealing between the elbow and bushing during the initial stages of the loadbreak operation itself. In alternative embodiments, the probe may be hollow and vented or include a groove or reduced radius surface disposed along its length.

The devices and methods of the present invention have particular application for electrical connections in the 15–35 KV voltage range. However, they may also be applied to other connections at other voltages.

BRIEF DESCRIPTION OF THE DRAWINGS

For a detailed description of a preferred embodiment of the invention, reference will now be made to the accompanying drawings, wherein.

DESCRIPTION OF THE PREFERRED EMBODIMENTS

The construction and operation of conventional electrical connector assemblies, which are in many respects similar to that described herein, are well known and have been in widespread use commercially for many years. Reference is made, for example, to U.S. Pat. No. 5,221,220, issued Jun. 22, 1993 to Rosciewski and assigned to the assignee of the present application.

Figure 1:
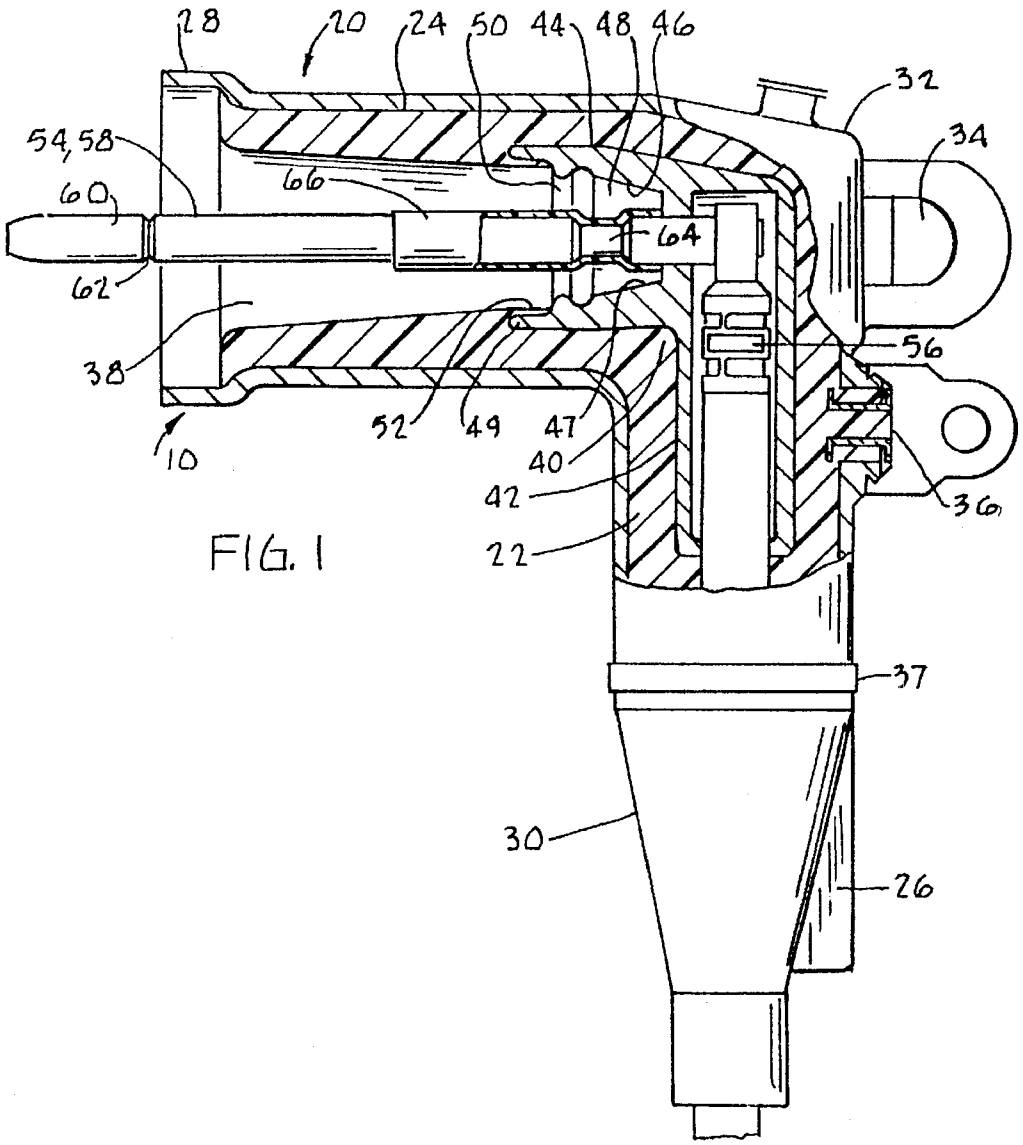
FIG. 1 is a cross-sectional view of an exemplary elbow shaped male connector constructed in accordance with the present invention.

Referring initially to FIG. 1, the electrical connector assembly 10 of the present invention includes a male contact connector 20, such as an elbow connector, electrically connected to a portion of a high-voltage circuit (not shown), and a female contact connector 100, as for example a bushing insert or connector, connected to another portion of the high-voltage circuit. As shown, the male contact connector 20 is in the form of a cable termination device, such as an elbow. Male and female contact connectors 20 and 100, are reversably connectable and respectively interfit to achieve electrical connection. In the preferred embodiment described herein, the connector assembly 10 is a 200 A, 250 KV class connector assembly.

The male connector 20 includes an elastomeric and electrically-resistive housing 22 of a material such as EPDM (ethylene-propylene-dienemonomer) rubber which is provided on its outer surface with a semiconductive shield layer 24 that may be grounded by means of a perforated grounding tab 26. The male connector 20 is generally elbow-shaped, being formed of an upper horizontal portion 28 and a lower vertical portion 30 connected at a central portion 32. A pulling eye 34 extends horizontally from the central portion 32. An optional test point 36 is located along the lower portion 30. In addition, an annular band 37 surrounds the lower portion 30 to identify the male connector 20 as a loadbreak rated device. Horizontally-oriented and generally conical bore 38 is disposed within the housing 22. A semiconductive insert 40 is contained within the housing 22 such that vertical portions 42 of the insert 40 extend into the lower portion 30 of the connector 20. A horizontally-disposed portion 44 of the insert 40 extends into the upper portion 28 of the connector 20 and presents an inner radial surface 46 which defines a conically-shaped recess 48. The insert 40 also presents an annular locking ring 50 which is inwardly directed within the recess 48 from the inner radial surface 46 of the insert 40. The locking ring 50 divides the inner radial surface 46 into a recessed area 47 and an extended area 49.

An insulative layer 52 of electrically-resistive material is disposed within the recess 48 of the insert 40. The insulative layer 52 is preferably also made of EPDM and may be unitarily molded with portions of the housing 22 during manufacture. The insulative layer 52 preferably extends from the inner surface of the bore 38 along the inner surface 46 of the insert 40 to the locking ring 50 so that the extended area 49 of the inner surface 46 is insulated. Additionally, the recessed area 47 of the insert 40 may be insulated.

A male contact, or probe assembly 54 is largely contained within the housing 22 and aligned down the axis of the conical bore 38 the insert 40. A conductor contact 56 is applied to the cable conductor 55 to make electrical contact with the cable conductor 55 and is disposed within the lower portion of the male connector 20. The probe assembly 54 threadedly engages the conductor contact 56. The probe assembly 56 also features a male contact element or probe 58 is formed of a material such as copper and extends horizontally from the conductor contact 56 into the bore 38 of the upper portion 28 and the recess 48 of the insert 40. At the distal end of the probe extends an arc follower 60 of ablative material. A preferred ablative material for the arc follower 60 is acetal co-polymer resin loaded with finely divided melamine. The ablative material is typically injection molded onto a reinforcing pin (not shown). An annular junction recess 62 is disposed at the junction between the probe 58 and the are follower 60. A second annular, radially reduced recessed portion 64 is provided within the surface of the probe 58 so as to be nearly adjacent to the position of the locking ting 50 when the probe 58 has been assembled within the male connector 20. The recessed portion 64 is elongated along the longitudinal axis of the probe 58 and will typically measure between ½"–3" in length.

An insulative sheath 66 is disposed about the portions of the exterior of the probe 58. The sheath 66 should not cover the entire length of the probe 58 as at least the distal end of the probe 58 proximate to the arc follower 60 will need to be remain unsheathed so that an electrical connection may be made. It is preferred, however, that the sheath 66 should at least extend to and abut the recessed area 47 of the inner radial surface 46 of insert 40.

Figure 2:
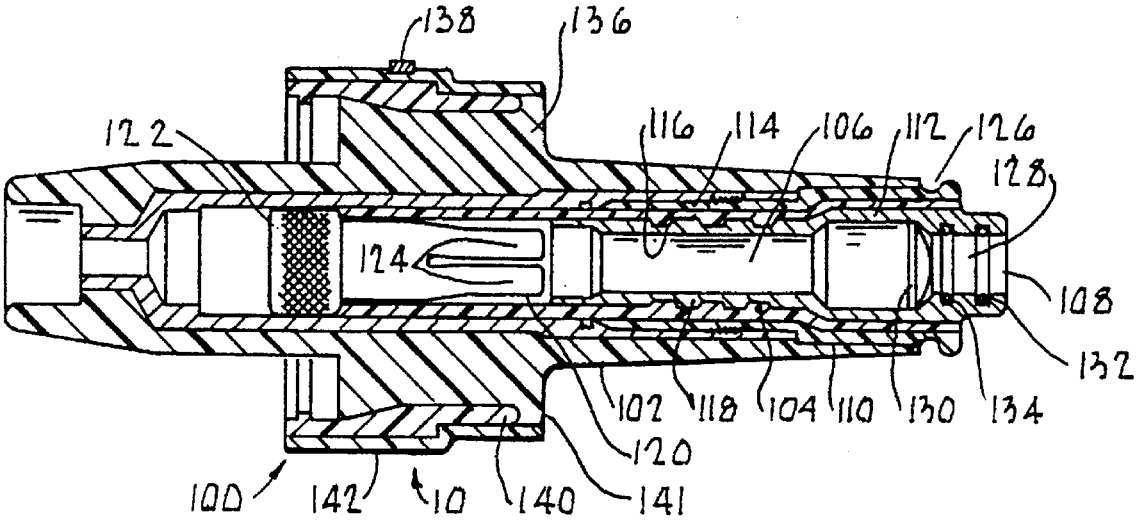
FIG. 2 is a cross-sectional view of an exemplary bushing-type female connector of the present invention.

FIG. 2 illustrates the female connector 100, which is featured as a bushing insert composed generally of an outer electrically resistive layer 102 and an inner rigid, metallic, electrically conductive tubular assembly with associated components, referred to herein as a contact assembly 104. The construction and operation of female connectors of this type is, of course, well-known in the art. However, the major components will be described here to the extent necessary to understand the invention. The female connector 100 is electrically and mechanically mounted to a bushing well (not shown) disposed on the enclosure of a transformer or other electrical equipment. The contact assembly 104 is generally cylindrical having a central passageway 106 therethrough which presents a forward opening 108. The passageway 106 is largely defined by a nose piece 110 having a radially central portion 112 and a radially surrounding portion 114. For purposes of description, the term "rear" shall mean the direction toward the bushing well of the electrical equipment and the term "forward" shall mean the direction toward the nose piece 110 and the male connector 20. The central portion 112 features an insulated chamber 116 having a metallic interior which is radially surrounded by an arc interrupter 118. A female contact 120 is disposed toward the rear of the chamber 116 and is maintained in a radially central position by a copper knurled piston 122 through which the female contact 120 is electrically and mechanically coupled to a bushing well (not shown). The female contact 120 has forwardly extending collet fingers 124 which are fashioned to grip the probe 58 of the male connector 20. Nose piece 110 has an external circumferential locking groove 126 which serves as a securing detent for a complimentary locking ring associated with the insert 40 of the male connector 20.

The forward end of the central passageway 106 includes an entrance vestibule 128 immediately rearward of opening 108. The vestibule 128 is separated from the chamber 116 by a hinged gas trap 130 which is operable between an open position, wherein gas communication is possible between the chamber 116 and the vestibule 128, and a closed position, wherein gas communication is substantially prevented between the chamber 116 and vestibule 128. The gas trap 130 is spring-biased toward the closed position and may be moved to its open position as the probe 58 of the male connector 20 is disposed within the central passageway 106 through the vestibule 128 and into the chamber 116. A pair of elastomeric O-rings 132, 134 are located within the vestibule 128. When the connectors 20 and 100 are fully engaged, O-ring 132 is located in the recessed portion 64 of probe 58 in an uncompressed condition to prevent distortion of the elastomeric material making up the O-ring 132.

A portion of the outer electrically resistive layer 102 forms a radially enlarged section 136 which surrounds the copper tube 112. One or more ground tabs 138 are provided and are positioned at the radial exterior of the enlarged section 136. The enlarged section 136 also carries an annular semi-conductive shield 140 about its circumference which presents a forward bushing shoulder 141. In conventional electrical connector assemblies, this shield 140 presents a ground plane to which an arc might tend toward during a flashover. A thin sleeve of insulative material 142 is disposed along the outer radial surface of the semi-conductive shield 140. The sleeve 142 may be of any suitable shape, thickness or material. It is preferred, however, that the sleeve 142 be formed of an insulative polymeric material such as rubber or plastic. A suitable thickness for the sleeve 142 has been found to be 0.015–0.060". The sleeve 142 preferably extends rearward from the bushing shoulder 141 to cover some portion of the shield 140. Preferably, the sleeve 142 encloses or encapsulates the entire outer radial surface of the shield 140.

During a loadbreak or switching operation, the male connector 20, i.e. elbow and probe assembly, is separated from the female connector 100, i.e. bushing insert. The connectors are energized when they are electrically connected to a high voltage distribution current. During loadbreak operation separation of electrical contact occurs between the probe 58 and female contact 120 creating a mechanical drag between the probe 58 and collet fingers 94 of female contact 120. Upon disconnection, arcing occurs as the probe 58 and fingers 94 separate. The arcing is expected to be generally extinguished within the chamber 116 through the generation of arc-quenching gases by components within the chamber. These gases are directed inwardly within the central passageway 106 of the female connector 100. In a conventional connector assembly, arcing may unexpectedly and undesirably occur during loadbreak operation, the arc likely extending from exposed conductive portions of the probe 58 or the insert 40 to a nearby available ground plane. In most cases, the ground plane is the annular semi-conductive shield 140 of the female connector 100 which is grounded through the ground tabs 138.

In the arrangement of the present invention, the likelihood of this type of arcing is reduced because the flashover distance is increased between potential flashover points on the male and female connectors 20, 100. The conductive surface provided by the extended area 49 of the inner radial surface 46 of the insert 40 is effectively removed through the provision of the insulative layer 52. As a result, an arc originating from the insert 40 of the male connector 20 would need to extend to the recessed portion 47 of the insert 40, an area which is located a greater physical distance from the female connector 100 than the extended portion 49 in a conventional connector assembly. Additionally, a portion of the conductive surface area of the probe 58 is insulated by sheath 66. In preferred embodiments in which the sheath 66 meets the insert 40, the conductive surface area of the probe 58 is effectively removed other than the distal area proximate the arc follower 60 which generally remains engaged with portions of female contact 120 during loadbreak. Also, the presence of insulative sleeve 142 surrounding the semi-conductive sleeve 140 of the female connector 100 increases the effective flashover distance. Because the flashover distance is increased both actually and effectively, it becomes less likely that arcing will occur. The arrangement and methods of the present invention also reduce the risk of flashover by helping to maintain the dielectric strength of the air surrounding the energized portions of the connector assembly 10 during the loadbreak process.

Figure 3:
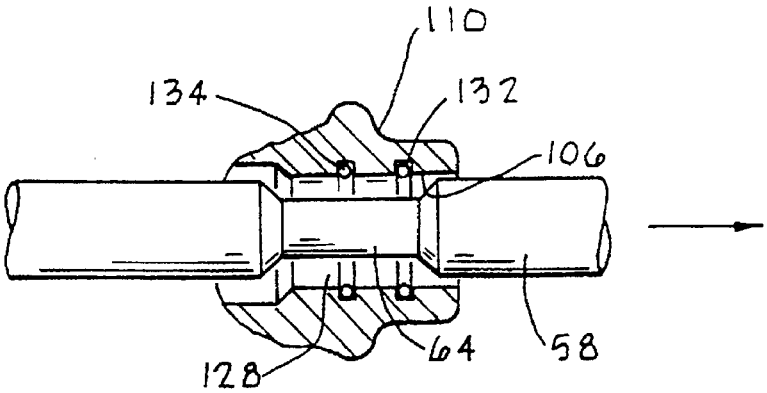
FIG. 3 is a cross-sectional detail showing potions of the male and female connectors of the present invention fully interengaged in their normal at rest position.
Figure 4:
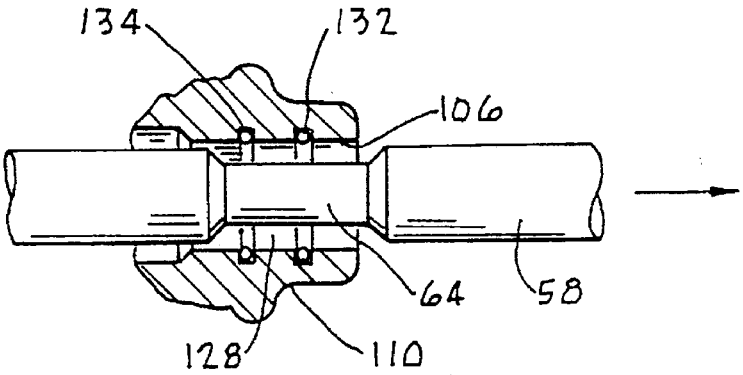
FIGS. 4 and 5 is a cross-sectional detail showing portions of the male and female connectors of the present invention during the initial portion of loadbreak separation.
Figure 5:
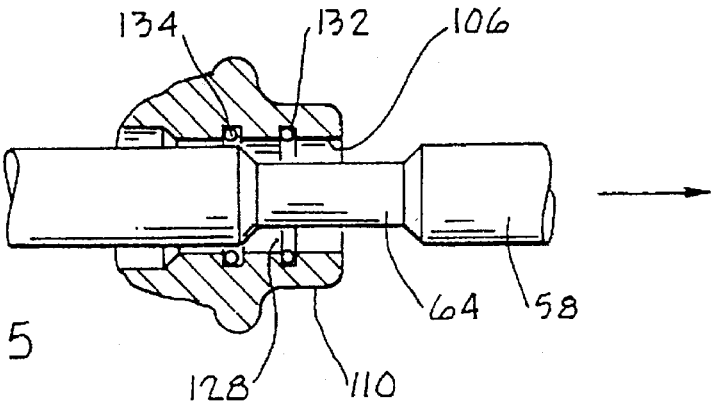

FIGS. 3, 4 and 5 illustrate portions of a connection between the connectors 20, 100. The illustrated portions include a forward section of the nose piece 110 wherein the O-rings 132, 134 are retained within the vestibule 128. In FIG. 3, the connectors 20, 100 are fully engaged such that the probe 58 is fully disposed within the central passageway 106. Due to the recessed portion 64 of probe 58 the elastomeric O-rings 132 and 134 of the female connector 100 do not make a positive seal against the outer portion of the sheath 66 surrounding the probe 58. Prior to loadbreak, the recessed potion 64 extends upon either axial side of each of the O-rings 132 and 134 so that the O-rings extend radially within the recessed portion 64. No positive seal is maintained between the O-rings and the sheath 66 such that there is slight venting of air into the chamber 116.

During the initial portion of a loadbreak operation, as shown in FIG. 4, the probe 58 is withdrawn from the central passageway 106. Due to the extended length of recessed portion 64, slight venting is permitted during the initial ⅜" to 1" of travel during the withdrawl of the probe 58, the portion of the withdrawl during which arcing is most likely to occur. Thereafter, O-ring 134 may contact the probe 58 as shown to create a seal as the subsequent portion of the loadbreak takes place. See FIG. 5.

It is noted that the venting between the connectors may be accomplished through alternative methods. For example, an air passage might be disposed within the probe having openings to and permitting gas communication between the interior of the chamber 116 and the vestibule 128 (or other exterior areas) during the initial stages of the loadbreak operation. Additionally, the outer surface of the probe might be longitudinally grooved so as to permit this type of gas communication.

Figure 6:
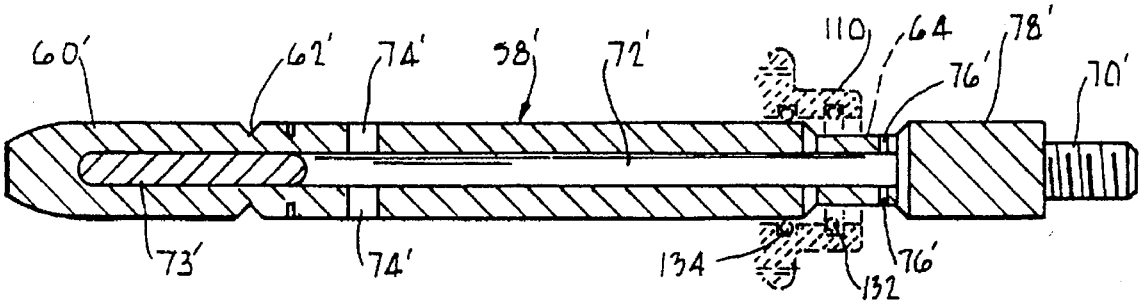
FIG. 6 is a cross-sectional detail showing portions of an exemplary vented probe used with an alternative embodiment of the present invention.

FIG. 6, for example, illustrates a hollow and vented probe 58'. Probe 58', while shown apart from the male connector 20 into which it would be fitted, is, in most respects, constructed identically to the probe 58 described earlier. Similar components will, therefore, be numbered alike. The proximal end of the probe 58' includes a threaded extension 70' with which to be attached to the male connector 20. Recessed area 64' may or may not be extended in length as was the recessed area 64 in probe 58. A portion of nose piece 110 is shown in phantom to illustrate the conventional sealing of O-ring 134 when the connectors 20, 100 are interfitted as previously described. A longitudinal vent passage 72' is disposed through the central portion of the probe 58'. Reinforcing rod 73' may be disposed within a distal portion of the passage 72' to improve the overall strength of the probe 58' against bending. One or more lateral openings 74' are disposed through the sides of the probe 58' at the distal portion of the passage 72'. Additionally, lateral openings 76' are disposed through the sides of the probe 58' at the proximal portion of the passage 72'. When probe 58' is used with connectors 20, 100, the two connectors being either entirely interfit or in the initial stage of loadbreak, the passage 72' permits communication of air between the chamber 116 and areas exterior of the connectors. It is suggested that lateral openings 76' be located at or near the proximal end of the recessed area 64'.

Figure 7A:
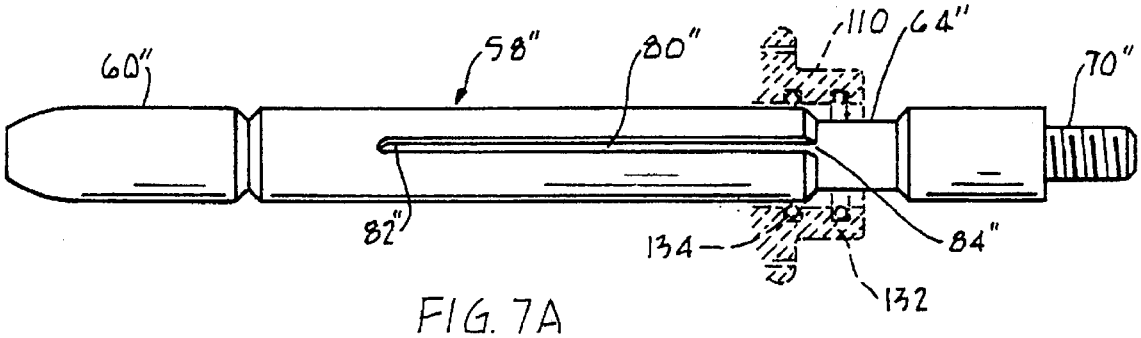
FIGS. 7A and 7B are top and side views, respectively, of an exemplary grooved probe used with an alternative embodiment of the present invention.
Figure 7B:
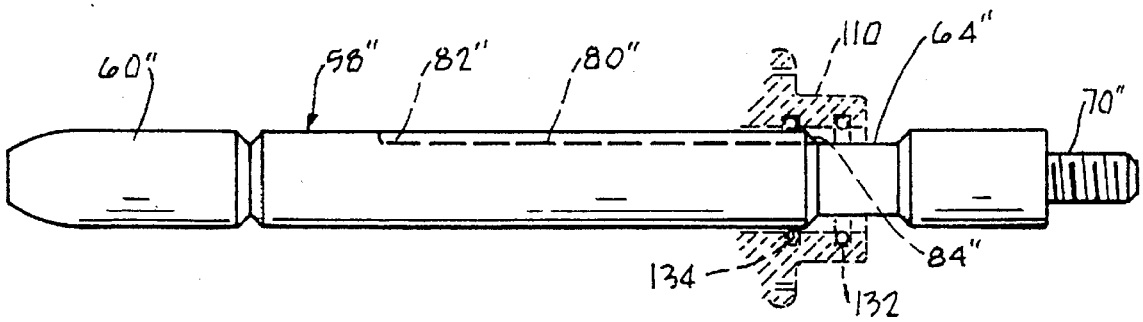

FIGS. 7A–7B illustrate a second alternate embodiment showing a probe 58" wherein an external groove 80" is adapted to permit communication of air between the chamber 116 and areas external to the chamber 116. Again, a portion of nose piece 110 is shown in phantom to illustrate the sealing of O-ring 134 against the probe 58 when the connectors 20, 100 are interfitted. The distal end of the groove 82" is capable of air communication between the groove 80" and the chamber 116 of the female connector 100 while the proximal end of the groove 84" is capable of air communication with areas external to the chamber 116.

For clarity, probes 58' and 58" have been shown without an external sheath 66, however, it is to be understood that those probes also would preferably incorporate such a sheath. The drawings are not necessarily to scale and certain features and certain views of the drawings may be shown exaggerated in scale or in schematic form in the interest of clarity and conciseness. While a preferred embodiment of the invention has been shown and described, modifications thereof can be made by one skilled in the art without departing from the spirit of the invention. For example, other methods of venting the chamber 116 to external areas could be used which are not specifically described herein. Additionally, air passages of many different configurations may be used within the probe of the male connector while remaining within the scope of the invention.

What is claimed is:

1. A connector assembly for connecting or disconnecting a circuit, comprising:

(a) a first connector member, comprising an electrically-resistive housing having a generally conically-shaped interior bore;

a semiconductive insert disposed within a portion of said bore, the insert presenting an inner radial surface which defines a generally conically-shaped recess;

an electrically-resistive insulative layer disposed extending from the conically-shaped interior bore along portions of the inner radial surface of the semiconductive insert; and (b) a second connector member adapted to reversably interconnect with the first connector member.

2. The connector assembly of claim 1 wherein the recess of the semiconductive insert presents an annular locking ring extending inwardly from the inner radial surface within said recess, and the insulative layer abuts the ring.

3. The connector assembly of claim 1 further comprising an elongated probe disposed within the body, said probe assembly having a sheath of insulative material over at least a portion of its length.

4. The connector assembly of claim 3 wherein the probe assembly includes an air passage to vent conductive portions of the connector assembly during a loadbreak operation.

5. The connector assembly of claim 4 wherein the air passage comprises an elongated radially reduced recessed portion.

6. The connector assembly of claim 5 wherein the recessed portion measures between ½" and 3" in length.

7. The connector assembly of claim 5 wherein the air passage comprises a hollow, vented portion of the probe.

8. The connector assembly of claim 5 wherein the air passage comprises a groove longitudinally disposed along the exterior of the probe.

9. A connector assembly for connecting or disconnecting a circuit, comprising:

(a) a first connector member;

(b) a second connector member, adapted to interconnect with the first connector member, the second connector member comprising:

an outer shield assembly, presenting an outer annular semiconductive sleeve, at least a portion of which is enclosed by an exterior sleeve of insulating material;

a conductive sleeve disposed within the outer shield assembly; and an electrical contact maintained within the conductive sleeve, said electrical contact adapted to contact a probe member associated with the first connector member.

10. The connector assembly of claim 9 further comprising a forward closure assembly within the conductive sleeve, the forward closure assembly comprising a pair of annular elastomeric seals.

11. The connector assembly of claim 10 wherein the first connector member further comprises an elongated probe adapted to contact the electrical contact within the conductive sleeve of the second connector member, said probe having an elongated radially reduced recessed portion which extends upon either axial side of each of the pair of O-rings when the first and second connector members are interconnected.

12. A connector assembly for connecting or disconnecting a circuit, comprising:

(a) a first connector member, comprising:

an electrically-resistive housing having a generally conically-shaped interior bore;

a semiconductive insert disposed within a portion of said bore, the insert presenting an inner radial surface which defines a generally conically-shaped recess;

an electrically-resistive insulative layer disposed extending from the conically-shaped interior bore along portions of the inner radial surface of the semiconductive insert; and (b) a second connector member adapted to reversably interconnect with the first connector member, the second connector member comprising:

an outer shield assembly, presenting an outer annular semiconductive sleeve, at least a portion of which is encapsulated by an exterior sleeve of insulating material;

a conductive sleeve disposed within the outer shield assembly; and an electrical contact maintained within the conductive sleeve, said electrical contact adapted to contact the probe of the first connector member.

13. A method for reducing the risk of flashover between electrical connectors during disconnection of first and second connectors, comprising insulating a conductive portion of a first connector so as to increase the flashover distance between the first connector and a complimentary second connector.

14. The method of claim 13 further comprising the step of insulating a potential proximate ground portion of a second connector, said second connector adapted to reversably interconnect with the first connector to form an electrical connection.

15. A method for reducing the risk of flashover between reversably interfittable electrical connectors during disconnection of first and second connectors by preventing loss of dielectric strength of air surrounding energized portions of the connectors, the method comprising the steps of:

(a) venting a chamber surrounding energized portions of the connectors during disconnection of the connectors; and (b) preventing a seal against air flow proximate energized portions of the connectors during a portion of the process of disconnection of the first and second connectors.

16. The method of claim 15 wherein venting is accomplished by disposing an air passage between the chamber and an area external to the chamber, the passage capable of communication of air between the chamber and the external area while the first and second connectors are interfit.

17. The method of claim 16 wherein the air passage comprises a groove disposed longitudinally along the exterior surface of a longitudinal probe of one of the connectors which is adapted to be disposed within the chamber, the groove having a distal end adapted to be in communication with the chamber when the first and second connectors are interfit and a proximal end adapted to be in communication with areas external to the chamber when the first and second connectors are interfit.

* * * * *